US005892232A

United States Patent [19]

Tsai et al.

[11] Patent Number: 5,892,232

[45] Date of Patent: Apr. 6, 1999

[54] ARC CHAMBER FOR ION IMPLANTER

[75] Inventors: Pei-Wei Tsai; Tzu-Hsin Huang; Hua-Jen Tseng; Min-Huei Lin, all of Hsinchu, Taiwan

[73] Assignee: Mosel Vitelic Inc., Hsinchu, Taiwan

[21] Appl. No.: 735,981

[22] Filed: Oct. 25, 1996

[51] Int. Cl.[6] ..... H01J 27/00

[52] U.S. Cl. ..... 250/426; 250/423 R; 315/111.81

[58] Field of Search ..... 250/426, 423 R; 315/111.81; 313/275, 277, 359.1

[56] References Cited

U.S. PATENT DOCUMENTS

| | | | |
|---|---|---|---|
| 4,954,751 | 9/1990 | Kaufman et al. | 315/111.81 |
| 5,049,784 | 9/1991 | Matsudo | 315/111.81 |
| 5,162,699 | 11/1992 | Tokoro et al. | 250/423 R |
| 5,252,892 | 10/1993 | Koshitishi et al. | 315/111.81 |
| 5,256,947 | 10/1993 | Toy et al. | 315/111.81 |

*Primary Examiner*—Bruce Anderson
*Attorney, Agent, or Firm*—Harness, Dickey & Pierce, P.L.C.

[57] ABSTRACT

An arc chamber including a reaction chamber, a filament element used to generate electrons, a first power supply means set for providing power to the filament element, a second power supply means utilized for creating a potential to increase the ionization efficiency, a plurality of gas injected openings set to inject suitable gas into the reaction chamber and be ionized in a gaseous plasma by impact from electrons, a first filament insulator, and three second filament insulators used for isolation. The first filament insulator includes a truncated corn portion and a ring portion. The truncated corn portion has a hole formed threrethrough itself. The ring portion is coaxially connected to the smaller surface of the truncated corn portion. The second filament insulator includes a truncated corn portion and two ring portions. Similarily, the truncated corn portion has a hole through formed therethrough. The ring portions are respectively coaxially connected to the two surfaces of the truncated corn portion. In the preferred embodiment, three first filament insulators and one second filament insulator are set on the filament element for isolation. The filament insulators are screwed into the filament element and exactly attached on the side wall of the reaction chamber.

20 Claims, 4 Drawing Sheets

ARC CHAMBER FOR ION IMPLANTER

FIELD OF THE INVENTION

The present invention relates to an ARC chamber for ion implanting equipment, and more specifically, to a filament insulator of an ARC chamber.

BACKGROUND OF THE INVENTION

In VLSI fabrication, an ion implantation is primarily used to add dopant ions into the surface of silicon wafer. Ion implantation is a process in which energetic, charged atoms or molecules are directly introduced into a substrate. In order to benefit from the ability to control the number of impurities implanted into a substrate, it is necessary to know where the implanted atoms are located after implantation.

Ion implanters are one of the most complex systems used in the formation of VLSI. They contain many subsystem, including the following: (1) A feed source of material containing the species to be implanted; (2) An ion source, with its own power supply and vaccum pump, to ionize the feed gas and to produce a plasma (the ions are typically formed through collision with electrons from an arc discharge); (3) An ion extraction and analyzing device that selects only the ion species of interest according to their mass and rejects all others; (4) An acceleration tube which creates an acceleration field to increase the ion energy to a desired level; (5) A scanning system to distribute the ions uniformly over the target; (6) A high vacuum system for evacuating the source, acceleration column, and beam chamber; (7) A computer and a control system; (8) A system end station, which includes an area defining an aperature, a Faraday cup and current integrator and a subsystem that loads, holds, and positions the target.

The ion source starts with an approriate molecular species and converts it into ions. The ions are accelerated and then enter the mass analyzer for ion selection. The exit beam of desired implant ions is chosen based on the charge-to-mass ratio of the ions. The ions are then given a final acceleration after which the ion beam will be slightly electrostatically deflected to separate it from any neutral atoms that may have formed. The beam is then scanned over the wafer surface.

The ion source supplies ions, usually singly positively charged, in enough quantity to provide beam currents of from 10 $\mu$A to 100 mA, depending on the rating of the implanter. Further, the source must be constructed so that the ions produced can be extracted and formed into a collimated beam. The species to be ionized, which may already be gaseous or be vaporized in or near the source, is confined in a chamber and ionized in a gaseous plasma by impact from electrons. In most cases, the electrons come from a hot filament, and electrons are generated by secondary emission from positive ion bombardment. Also a magnetic field is usually provided to cause spiraling of the electrons, thus increasing the length of the path traveled before the electrons reach the anode and thereby improving ionization efficiency.

Basically, the ion source includes a vaporizer, an arc chamber and a magnet element. Referring to FIG. 1, a conventional arc chamber includes a reaction chamber 10, a filament element 12 used to generate electrons, a first power supplier 14 for providing power to the filament element 12, a second power supplier 16 to create a potential between the filament element 12 and the reaction chamber 10 to increase the ionization efficiency and guide the ions to the extractor, a plurality of gas injection openings 18 to inject suitable gas into the reaction chamber 10 and be ionized in a gaseous plasma by impact from electrons, and filament insulators 20 used for isolation between the filament element 12 and the reaction chamber 10.

As shown in FIG. 2, the filament element 12 and the filament insulators 20 are shown. The filament element 12 is typically surrounded by a first filament insulator 20*a* and a second filament insulator 20*b* for isolation. In addition, a set of retainers 20*c* which are formed of graphite are set between the reaction chamber 10 and the filament insulators 20. FIG. 3*a* is a cross section view of the first filament insulator 20*a*. The first filament insulator 20*a* is an cylinder having both an internal spiral and an external spiral. Further, the first filament insulator 20*a* has a ring portion 22*a* at one end. The internal spiral is used to threadably mate with the filament element 12, and the external spiral is used to threadably mate with retainer 20*c*. The external and internal diameters b1, a1 of the first filament insulator 20*a* are respectively 0.3, 0.16 and 0.44 inch in length d1. The length c1 of the ring portion 22*a* is 0.12 inch and 0.5 inch in diameter e1. The first filament insulator 20*a* has 18 external spiral threads per inch and 32 internal spiral threads per inch. FIG. 3*b* is a cross section view of the second filament insulator 20*b*. The second filament insulator 20*b* is also a cylinder having both an internal spiral and an external spiral. Moreover, the second filament insulator 20*b* has a first ring portion 22*c* and a second ring portion 22*b* at one end. The internal spiral is used to threadably mate with the filament element 12, and the external spiral is used to threadably mate with retainer 20*c*. The external and internal diameters b2, a2 of the second filament insulator 20*b* are respectively 0.3, 0.16 and 0.44 inch in length d2. The length c2 of the first ring portion 22*c* is 0.12 inch. The length e2 of the second ring portion 22*b* is 0.12 inch and 0.3 inch in diameter. In addition, the second filament insulator 20*b* has 18 external spiral threads per inch and 32 spiral threads per inch for internal spiral threading.

Typically, a procedure called PM is needed after the arc chamber is used for a period of time. That is, the filament element 12 has to be dismantled from the arc chamber for removing reaction residues coated on the filament element 12. Unfortunately, the first filament insulator 20*a* and the second filament insulator 20*b* cannot always be screwed out from the filament element 12 due to the large contact surface with each other. In order to dismantle the filament element 12, the only way is to break down the first filament insulator 20*a*, and the second filament insulator 20*b*. In general, the first and second filament insulators 20*a* and 20*b* cost U.S. $23.10, and $27.50, respectively. Further, the conventional arc chamber needs a set of graphite retainers for isolation. On the average, the first and second filament insulators 20*a* and 20*b* can only be used about 1.5 times. Therefore, this not only raises the cost but also complicates PM.

SUMMARY OF THE INVENTION

The present invention includes a reaction chamber, a filament element used to generate electrons, a first power supply means set for providing power to the filament element, a second power supply means utilized for creating a potential to increase the ionization efficiency, a plurality of gas injected openings set to inject suitable gas into the reaction chamber and be ionized in a gaseous plasma by impact from electrons, a first filament insulator, and a plurality of second filament insulators are used for isolation.

The filament element is surrounded by the first filament insulator and the second filament insulators for isolation. The first filament insulator includes a truncated corn portion and a ring portion. The truncated corn portion has a hole formed therethrough. The ring portion is coaxially connected to the smaller surface of the truncated corn portion. Moreover, the first filament insulator has 32 internal spiral threads per inch used for threadably mating with the filament element.

The second filament insulator includes a truncated corn portion and two ring portions. Similarily, the truncated corn portion has a 0.16 inch diameter hole formed therethrough. The diameter of the two side surfaces of the truncated corn portion are 0.5 inch and 0.37 inch, respectively. The ring portions are respectively coaxially connected to the two surfaces of the truncated corn portion. In addition, the second filament insulator has 32 internal spiral threads per inch used for threadably mating with the filament element. In the preferred embodiment, three first filament insulators and one second filament insulator are set on the filament element for isolation. The filament insulators are screwed into the filament element and are exactly attached on the side wall of the reaction chamber.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

An arc chamber is disclosed for the semiconductor industry. The detailed description of the invention will be described as follows.

Figure 1:
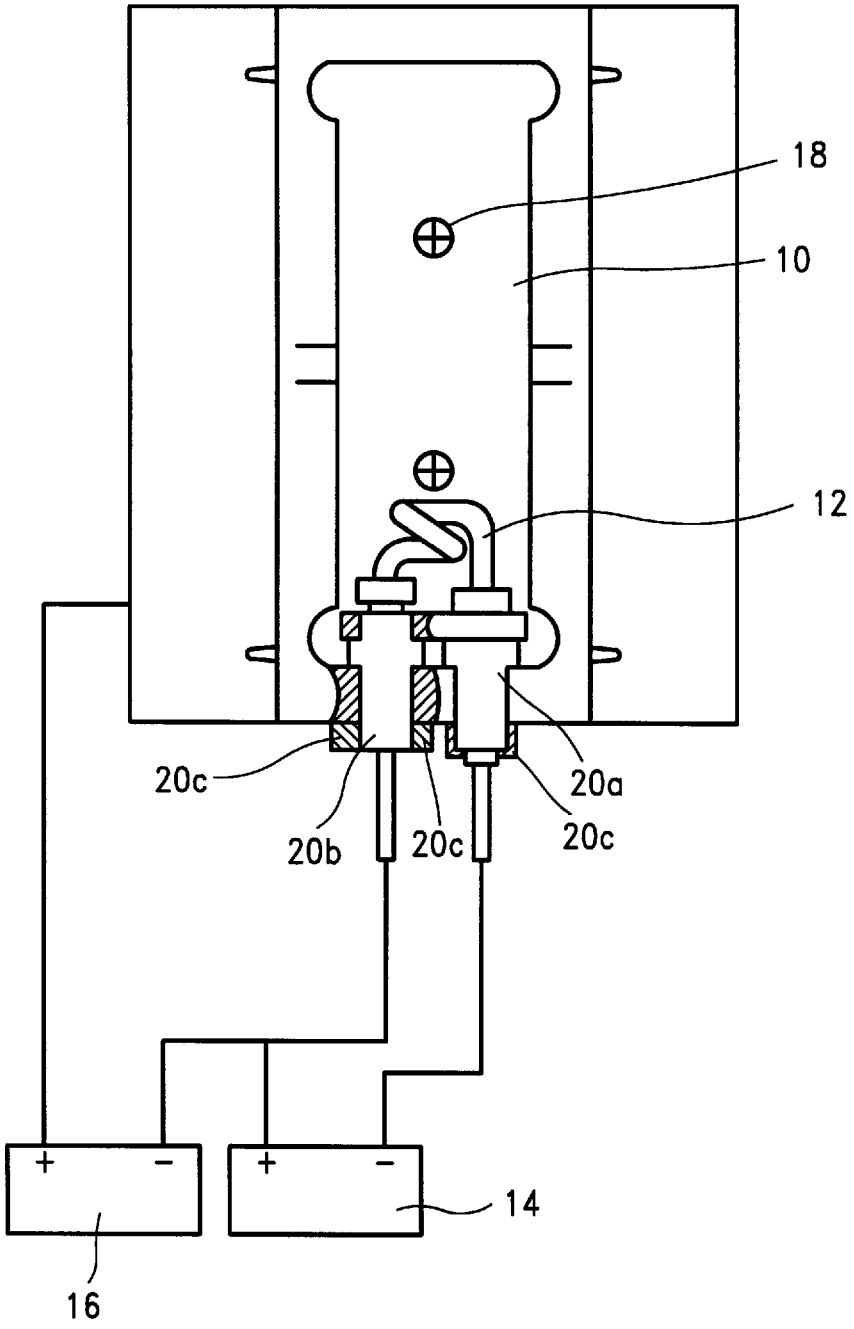
FIG.1 (PRIOR ART)
FIG. 1 is an arc chamber of the prior art.
Figure 2:
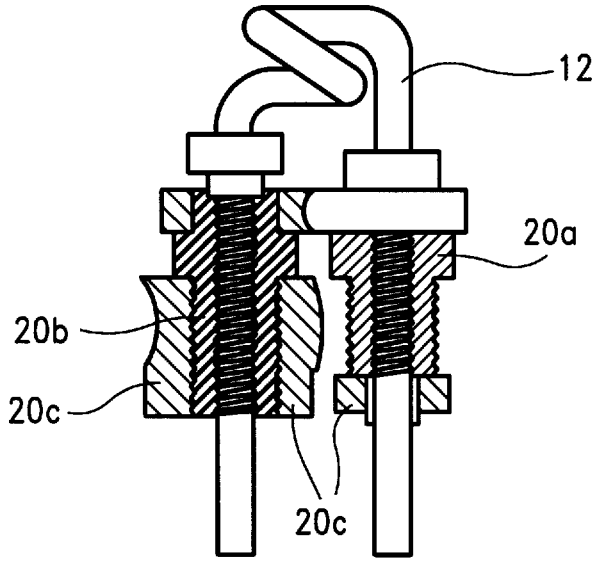
FIG.2 (PRIOR ART)
FIG. 2 shows a filament element with filament insulators of the prior art.
Figure 3A:
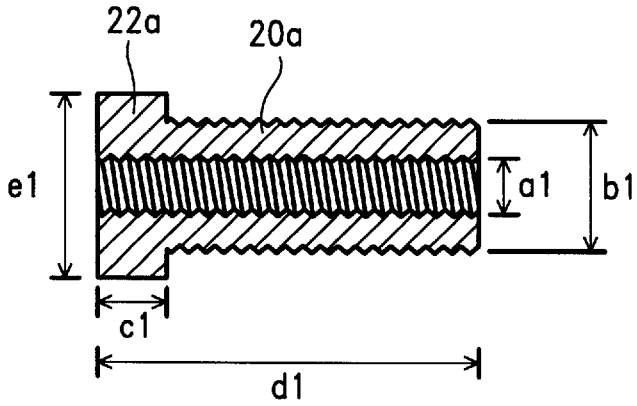
FIG.3a (PRIOR ART)
FIG. 3*a* is a cross section view of the first filament insulator of the prior art.
Figure 3B:
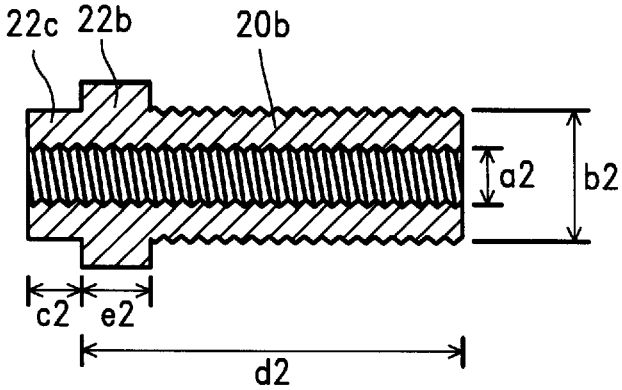
FIG.3b (PRIOR ART)
FIG. 3*b* is a cross section view of the second filament insulator of the prior art.
Figure 4:
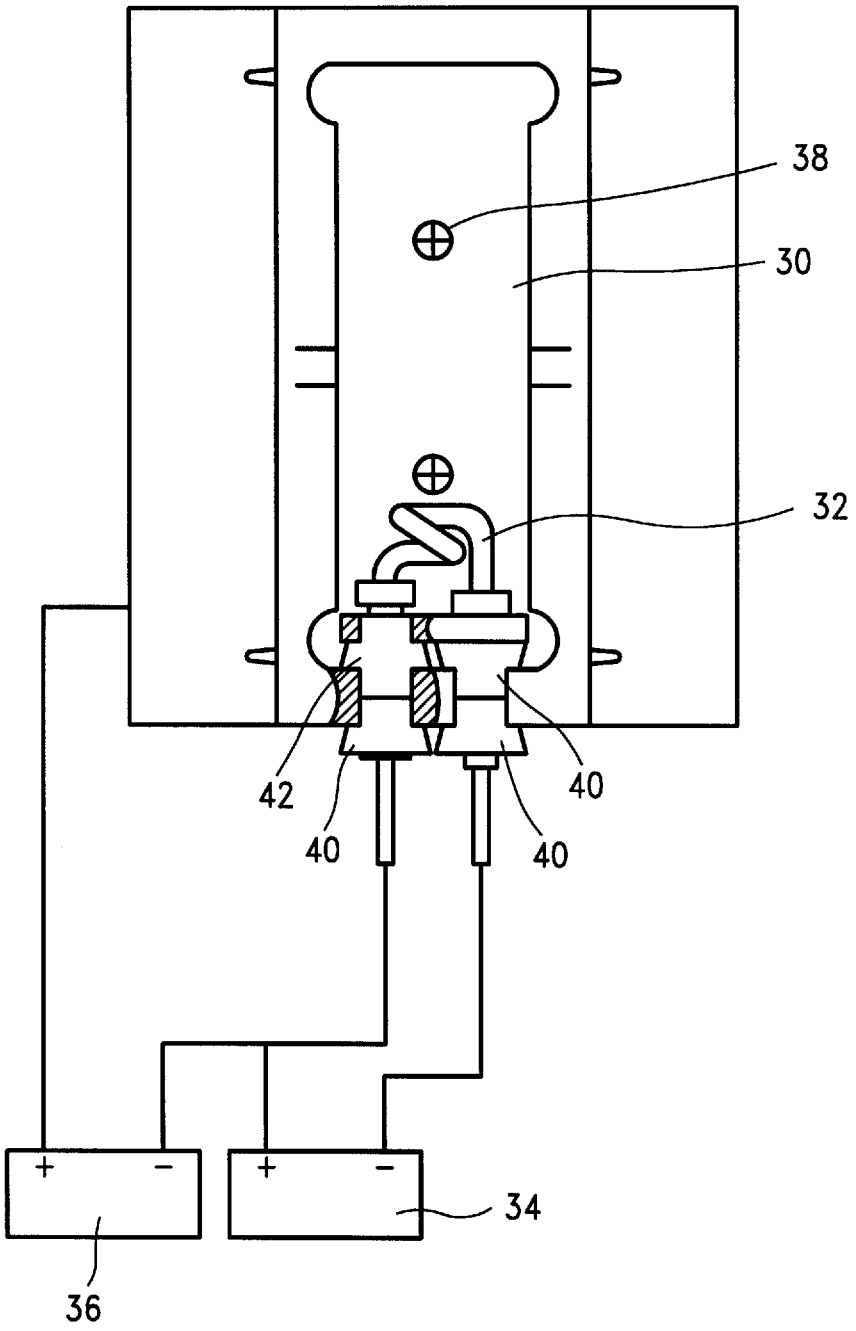
FIG. 4 is an arc chamber of the present invention.

FIG. 4 shows an arc chamber formed in accordance with the present invention. The present invention includes a reaction chamber 30, a filament element 32 used to generate electrons, first power supply means 34 set for providing power to the filament element 32, second power supply means 36 utilized for creating a potential between the filament element 32 and the reaction chamber 30 to increase the ionization efficiency and guide the ions to the extractor, a plurality of gas injected openings 38 set to inject suitable gas into the reaction chamber 30 and be ionized in a gaseous plasma by impact from electrons, a plurality of first filament insulators 40, and a second filament insulator 42 used for isolation between the filament element 32 and the reaction chamber 30.

Figure 5:
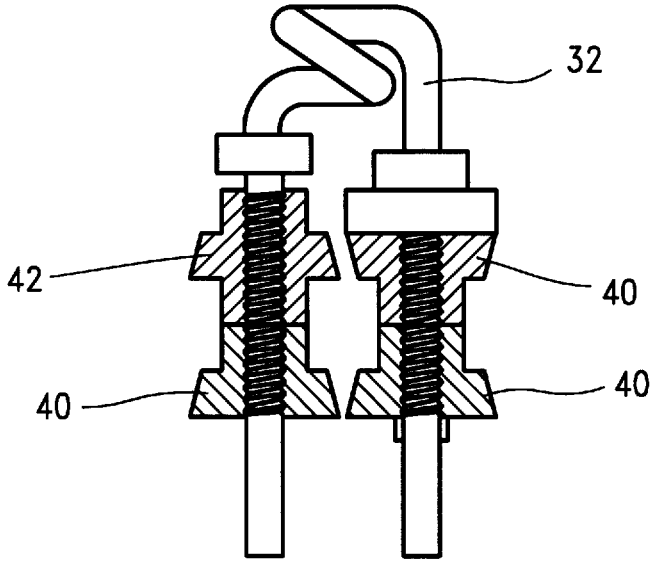
FIG. 5 shows a filament element with filament insulators of the present invention.

The reaction chamber 30 provides space to generate plasma for a semiconductor process such as ion implantation. The filament element 32 is used to generate electrons to collide with reaction gas for generating plasma, which is attached to one end of the reaction chamber 30. The first power supply means 34 is connected to the filament element 32 for providing power to the filament element 32. The second power supply means 36 is utilized for creating a potential in the arc chamber 30. In order to achieve the purpose, low voltage of the second power supply means 36 is connected to the filament element 32, while high voltage is connected to the side wall of the reaction chamber 30. Thus an electric potential is generated between the filament element 32 and the reaction chamber 30 which creates an acceleration field to increase the ionization efficiency. The injected gas openings 38 are set on the side wall of the reaction chamber 30 for injecting reaction gas into the chamber 30. The filament element 32 is wrapped around by the first filament insulators 40, and the second filament insulator 42 for isolation. Preferably, as shown in FIG. 5, the filament element 32 is wrapped around by one first filament insulator 40 and three second filament insulators 42. This is because the filament insulators 40, 42 have to be compatible with the EATON NV-GSD 80/160 (a kind an ion implanter).

Figure 6A:
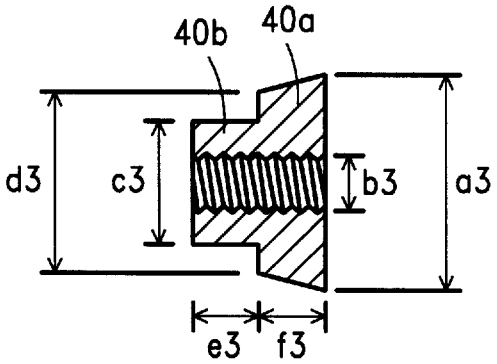
FIG. 6*a* is a cross section view of the first filament insulator of the present invention.

FIG. 6*a* is a cross section of the first filament insulator 40. The first filament insulator 40 includes a truncated corn portion 40*a* and a ring portion 40*b*. The truncated corn portion 40*a* has a hole formed therethrough. The diameter b3 of the hole is about 0.16 inch. Further, the areas of the two side surfaces of the truncated corn portion 40*a* are different. The larger surface has 0.5 inch in diameter a3 while the smaller one d3 is 0.37 inch. The ring portion 40*b* is coaxially connected to the smaller surface of the truncated corn portion 40*a*. The internal diameter b3 of the ring portion 40*b* is about 0.16 inch and the external diameter c3 is 0.3 inch. Preferably, the height e3 of the ring portion 40*b* is about 0.12 inch and the height f3 of the truncated corn portion 40*a* is about 0.12 inch. Moreover, the first filament insulator 40 has 32 internal spiral threads per inch used for threadably mating with the filament element 32.

Figure 6B:
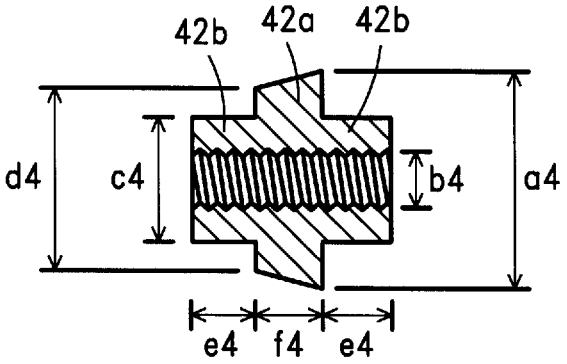
FIG. 6*b* is a cross section view of the second filament insulator of the present invention.

FIG. 6*b* is a cross section view of the second filament insulator 42. The second filament insulator 42 includes a truncated corn portion 42*a* and two ring portions 42*b*. Similarily, the truncated corn portion 42*a* has a hole with 0.16 inch in diameter b4 through itself. The diameter a4, d4 of the two side surfaces of the truncated corn portion 42*a* are 0.5 inch and 0.37 inch, respectively. The ring portions 42*b* are respectively coaxially connected to the two surfaces of the truncated corn portion 42*a*. The internal diameter b4 of the ring portion 42*b* is about 0.16 inch and the external one c4 is 0.3 inch. Preferably, the height e4 of the ring portion 42*b* is about 0.12 inch and the height f4 of the truncated corn portion 42*a* is about 0.12 inch. In addition, the second filament insulator 42 has 32 internal spiral threads per inch used for threadably mating with the filament element 32.

Turning to FIG. 5, in the preferred embodiment three first filament insulators 40 and one second filament insulator 42 are set on the filament element 32 for isolation. Still referring to FIG. 5, two first filament insulators 40 are threadably mating with one of the terminals of the filament element 32. Preferrably, the ring portions 40*b* of the two filament insulators 40 are disposed face-to-face and are connected with each other. Further, the truncated corn portions 40*a* are exactly attached on the side wall of the reaction chamber 30. Moreover, the second filament insulator 42 is threadably mated with the inner portion of another terminal of the filament element 32. Then the ring portion 40*b* of the third first filament insulator 40 is subsequently connected to the ring portion 42*b* of the second filament insulator 42. Similarily, the truncated corn portions 40*a*, 42*a* of both are exactly attached on the side wall of the reaction chamber 30.

On the average, the first and second filament insulators 40, 42 can be used more than 4 times and cost U.S. $6.60 and $11.00, respectively. Further, the present invention does not need a set of graphite retainers. Therefore, the cost of the PM is reduced and the efficiency of the PM is also improved by the present invention. The comparison between the invention and the prior art is shown in TABLE 1. The numbers in TABLE 1 represent the number of the filament which was broken in the corresponding week.

TABLE 1

| | PRESENT INVENTION | | PRIOR ART | |
|---|---|---|---|---|
| | first filament insulator | second filament insulator | first filament insulator | second filament insulator |
| 1st week | 0 | 0 | 1 | 1 |
| 2nd week | 0 | 0 | 1 | 0 |
| 3rd week | 0 | 0 | 1 | 1 |
| 4th week | 1 | 0 | 0 | 1 |
| 5th week | 1 | 0 | 0 | 1 |
| 6th week | 1 | 1 | 1 | 0 |
| 7th week | 1 | 0 | 1 | 1 |
| 8th week | 1 | 1 | 0 | 1 |
| total | 5 | 2 | 5 | 6 |
| average | 4.8 times | 4 times | 1.6 time | 1.33 times |

As is understood by a person skilled in the art, the foregoing preferred embodiment of the present invention is illustrative of the present invention rather than limiting the present invention. It is intended to cover various modifications and similar arrangements included within the spirit and scope of the appended claims, the scope of which should be accorded the broadest interpretation so as to encompass all such modifications and similar structure.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An arc chamber for an ion implanter, said arc chamber comprising:

a reaction chamber for providing space to generate plasma;

a filament element attached on one end of said reaction chamber for generating the plasma;

a first power supply means connected to said filament element for providing power to said filament element;

a second power supply means for creating a potential in said arc chamber, low voltage of said second power supply means being connected to said filament element, with high voltage being connected to the side wall of said reaction chamber;

a plurality of injected gas openings set on the side wall of said reaction chamber for injection reaction gas into said reaction chamber;

three first filament insulators set on said filament element for isolation; and a second filament insulator set on said filament element for isolation, said second filament insulator being set on one terminal of said filament element, one of said first filament insulators being connected to said second filament insulator, the other two of said first filament insulators being set on another terminal of said filament element.

2. The arc chamber of claim 1, wherein said first filament insulator comprises:

a truncated corn portion having a hole and two side surfaces, the area of said two side surfaces being different and;

a ring portion coaxially connected to the smaller surface of said truncated corn portion.

3. The arc chamber of claim 2, wherein the diameter of said hole is about 0.16 inch.

4. The arc chamber of claim 2, wherein the diameter of said larger surface is about 0.5 inch.

5. The arc chamber of claim 2, wherein the diameter of said smaller surface is about 0.37 inch.

6. The arc chamber of claim 2, wherein the diameter of the internal diameter of said ring portion is about 0.16 inch.

7. The arc chamber of claim 2, wherein the diameter of the external diameter of said ring portion is about 0.3 inch.

8. The arc chamber of claim 2, wherein the height of said ring portion is about 0.12 inch.

9. The arc chamber of claim 2, wherein the height of said truncated corn portion is about 0.12 inch.

10. The arc chamber of claim 2, wherein said first filament insulator has 32 internal spiral threads per inch.

11. The arc chamber of claim 2, where said second filament insulator comprises:

a truncated corn portion having a hole and two side surfaces, the area of said two side surfaces being different; and two ring portions coaxially respectively connected to said two side surfaces of said truncated corn portion.

12. The arc chamber of claim 11, wherein the diameter of said hole is about 0.16 inch.

13. The arc chamber of claim 11, wherein the diameter of said larger surface is about 0.5 inch.

14. The arc chamber of claim 11, wherein the diameter of said smaller surface is about 0.37 inch.

15. The arc chamber of claim 11, wherein the diameter of the internal diameter of said ring portion is about 0.16 inch.

16. The arc chamber of claim 11, wherein the diameter of the external diameter of said ring portion is about 0.3 inch.

17. The arc chamber of claim 11, wherein the height of said ring portion is about 0.12 inch.

18. The arc chamber of claim 11, wherein the height of said truncated corn portion is about 0.12 inch.

19. The arc chamber of claim 11, wherein said first filament insulator has 32 internal spiral threads per inch.

20. The arc chamber of claim 11, wherein two of said first filament insulators are screwed into one of the terminals of said filament element, said ring portions of said two first filament insulators being face-to-face and connected with each other, said truncated corn portions of said two first filament insulators being exactly attached on the side wall of said reaction chamber, said second filament insulators being screwed into the inner portion of another terminal of said filament element, said ring portion of the third first filament insulator being connected to said ring portion of said second filament insulators, said truncated corn portions of said second filament insulators, said third first filament insulator being exactly attached on the side wall of said reaction chamber.

* * * * *